US007748390B2

(12) United States Patent
Kuglen

(10) Patent No.: US 7,748,390 B2
(45) Date of Patent: Jul. 6, 2010

(54) STRETCH COMB HAIR RETAINER

(75) Inventor: Francesca B. Kuglen, Oakland, CA (US)

(73) Assignee: Sennits, LLC, Oakland, CA (US)

( * ) Notice: Subject to any disclaimer, the term of this patent is extended or adjusted under 35 U.S.C. 154(b) by 631 days.

(21) Appl. No.: 10/764,279

(22) Filed: Jan. 22, 2004

(65) Prior Publication Data

US 2004/0211438 A1 Oct. 28, 2004
US 2009/0277467 A2 Nov. 12, 2009

Related U.S. Application Data

(60) Provisional application No. 60/466,244, filed on Apr. 28, 2003.

(51) Int. Cl.
*A45D 24/04* (2006.01)
*A45D 8/12* (2006.01)
*A45D 8/00* (2006.01)

(52) U.S. Cl. ..... 132/128; 132/275; 132/273

(58) Field of Classification Search ..... 132/273, 132/274, 275, 276–279, 128; D28/41–43; D2/627, 633; D11/1, 3–4
See application file for complete search history.

(56) References Cited

U.S. PATENT DOCUMENTS

| | | | | |
|---|---|---|---|---|
| 184,793 | A | 11/1876 | Morse | |
| 715,600 | A | 12/1902 | Pomeroy | |
| 852,273 | A | 4/1907 | Hess | |
| 904,566 | A | 11/1908 | Schwab | |
| 966,113 | A | 8/1910 | McCall | |
| 1,152,884 | A | 9/1915 | Damon | |
| 1,512,272 | A | 10/1924 | Burnet | |
| 1,540,102 | A | 6/1925 | Cohen | |
| 1,564,079 | A * | 12/1925 | Lorbiecki | 132/274 |
| 1,635,065 | A | 7/1927 | Watson | |
| 1,665,380 | A * | 4/1928 | Ruffio | 132/105 |
| 1,823,361 | A | 9/1931 | Hudson | |
| 2,312,813 | A | 3/1943 | Goldstein | |
| 2,386,682 | A | 10/1945 | Heineman | |

(Continued)

FOREIGN PATENT DOCUMENTS

| | | |
|---|---|---|
| FR | 594.906 | 3/1925 |

(Continued)

OTHER PUBLICATIONS

Product Catalog pages, Hairpieces, Braids, Accessories, "Look of Love International," pp. 2, 8, 30, 31, 32, and cover, copyright notice 1997.

(Continued)

*Primary Examiner*—Robyn Doan
(74) *Attorney, Agent, or Firm*—Beeson Skinner Beverly

(57) ABSTRACT

A stretch comb hair retainer has opposed combs (11, 13) connected together by elastic strands (a-h) that are secured at spaced intervals along the spines of the combs. The elastic strands are interwoven to form a elastic mesh (25) of stretchable openings (27, 29) between the combs which hold down the hair. Hair can be pulled through any of the multiple stretchable openings of the mesh if and as desired to create particular hair styles. The individual elastic strands of the elastic mesh can be used without decorative elements on the strands, or with decorative elements such as decorative beads (31, 33) of various sizes and shapes.

28 Claims, 6 Drawing Sheets

U.S. PATENT DOCUMENTS

| | | | | | |
|---|---|---|---|---|---|
| 2,651,310 | A | * | 9/1953 | Selson | 132/274 |
| D178,334 | S | | 7/1956 | Behr | |
| D179,754 | S | | 2/1957 | Behr | |
| D183,654 | S | | 11/1958 | Hambric | |
| 3,099,271 | A | | 7/1963 | Dubelier | |
| 3,120,852 | A | | 2/1964 | Sawyer | |
| 3,746,016 | A | * | 7/1973 | Goodman | 132/274 |
| 4,254,783 | A | | 3/1981 | Kim | |
| D272,861 | S | | 2/1984 | Incando | |
| 4,522,215 | A | | 6/1985 | Verducci | |
| D316,161 | S | | 4/1991 | Kuglen | |
| 5,154,196 | A | * | 10/1992 | Moffat | 132/278 |
| 5,174,312 | A | | 12/1992 | Adams | |
| D334,793 | S | | 4/1993 | Richardson | |
| 5,379,782 | A | | 1/1995 | Tabb | |
| 5,622,194 | A | | 4/1997 | Ledda-Vengerder | |
| 5,690,128 | A | | 11/1997 | Grimes | |
| 5,732,720 | A | | 3/1998 | Sears | |
| 5,826,593 | A | | 10/1998 | Haubrich | |
| D419,264 | S | | 1/2000 | Wallon et al. | |
| 6,041,792 | A | * | 3/2000 | Kennedy | 132/275 |
| D425,248 | S | | 5/2000 | Hawley | |
| 6,123,086 | A | | 9/2000 | Kuglen | |
| D439,014 | S | | 3/2001 | Pender | |
| 6,293,285 | B1 | * | 9/2001 | Schach | 132/200 |
| D451,246 | S | | 11/2001 | Zuckerman | |
| D483,522 | S | * | 12/2003 | Leslie | D28/33 |

FOREIGN PATENT DOCUMENTS

| | | | |
|---|---|---|---|
| JP | 09299131 | A * | 11/1997 |
| WO | WO 98/06295 | | 2/1998 |

OTHER PUBLICATIONS

Evita Peron Catalog pages, Summer 2003.
Francesca Kuglen, 2 photographs of version of double comb hair accessory first sold on QVC in May 2000.
Francesca Kuglen, photograph of version of double comb hair accessory first sold on QVC in May 2000.

* cited by examiner

STRETCH COMB HAIR RETAINER

CROSS-REFERENCE TO RELATED APPLICATIONS

This application claims the benefit of U.S. Provisional Application No. 60/466,244, filed Apr. 28, 2003.

BACKGROUND OF THE INVENTION

The present invention generally relates to hair retaining devices used for hair styling and ornamentation, and more particularly to stretch comb type hair retainers comprised of combs held in opposition to each other by stretch elastic members.

Stretch comb hair retainers are in widespread use and are most often used by women to create a particular hair style or to provide a hair ornamentation. U.S. Pat. No. 6,123,086, issued Sep. 26, 2000, to Francesca Kuglen, shows a stretch comb hair retainer wherein two opposed plastic combs are connected by a series of parallel, fabric-covered elastic bands. Such stretch comb retainers are used by flipping the combs on the ends of the elastic bands over to an inverted position (see FIG. 3), placing the retainer over a portion of the hair, typically a gathered portion, and then, while stretching the bands, inserting the combs into the hair at either side of the portion of hair being retained. The restoring force of the elastic bands of the retainer acts to hold the retainer in place.

Stretch comb hair retainers as shown in the Kuglen patent have a number of limitations and disadvantages. First, the elongated regions between the parallel elastic bands of the retainer allow hair to escape or fall out after the retainer is in place, making it difficult to maintain certain hair styles, particularly for women with hair which is thin or fine. These regions are also too large to provide much holding force for holding a gathered portion of hair pulled through the retainer. A further limitation of the stretch comb retainer disclosed in the Kuglen patent is that the wide elastic bands are inherently obtrusive and limit the retainer's use to hair styles dominated by the fabric-covered bands.

Still another disadvantage of prior stretch comb retainers such as disclosed in Kuglen relates to the use of relatively rigid plastic combs. When inserting the plastic combs into the hair, pressure is applied on the individual teeth of the combs. This pressure can cause the teeth to break off, making the stretch comb retainer unwearable. Plastic combs are also relatively bulky and obtrusive and do not have a great deal of staying power in the hair because the hair easily slides across the smooth surfaces of the plastic comb.

There is a need for a stretch comb hair retainer that overcomes the disadvantages and limitations of the stretch comb hair retainer disclosed in the Kuglen patent, one that provides greater flexibility in creating hair styles than has heretofore been possible.

SUMMARY OF THE INVENTION

The present invention provides a stretch comb hair retainer that can be made to be unobtrusive when worn, and that provides greater flexibility in styling hair. The stretch comb hair retainer of the invention is also relatively lightweight and easy to use, can be worn comfortably, and, in certain aspects of the invention, will resist breakage associated with stretch comb assemblies having plastic combs.

In one aspect of the invention, the stretch comb retainer is comprised of two opposed combs, each having a spine and parallel comb teeth projecting from the spine. The combs are connected together by a plurality of elastic strands that are secured at spaced intervals along the spines of the combs. The elastic strands are interconnected to form an elastic mesh of stretchable openings between the combs through which the wearer can pull a desired amount of hair. Hair can be pulled through any of the multiple stretchable openings of the mesh as desired to create particular hair styles. Alternatively, the mesh can simply be stretched over the hair without pulling any hair through. Further, the individual elastic strands of the elastic mesh can be used with or without decorative elements on the strands. For example, decorative beads of various sizes and shapes can be threaded onto the elastic strands to create different distinctive mesh designs. As compared to the decorative fabric disclosed in the Kuglen patent, beads have an advantage in that they are not stained by scalp oils, hair spray and the like, and can easily be wiped clean. Decorative elements, for example a pattern of diamonds, could be used on the strands to match other jewelry. It shall be understood that the elastic mesh can be formed by separate interwoven elastic strands or a continuous strand of elastic material woven down the combs.

In a further and separate aspect of the invention, the combs of the stretch comb hair retainer are provided in the form of wire combs, as opposed to plastic combs. The wire combs each have a spine which is suitably fabricated of metal, and a row of parallel projecting teeth formed of looped wire attached to the spine. The wire loops, while being suitably stiff to hold their shape, are also suitably flexible. They comfortably pass through the hair when the stretch comb retainer is placed on the wearer's head, and, if bent out of shape during use, they can easily be bent back into shape without affecting the usability of the retainer. The flexible wire loops thus solve the problem of breakage associated with plastic combs. They also result in a comb having a relatively low, unobtrusive profile.

It is understood that, while the elastic mesh aspect of the invention is preferably used with metal wire loop combs as above described, it would be possible and within the scope of the invention to use the elastic mesh with conventional plastic combs. Conversely, the application of wire loop combs to stretch comb hair retainers might be possible using conventional elastic bands as shown in the Kuglen patent or elastic connecting structures other than the elastic mesh design described herein. However, it is discovered that wire loop combs are particularly well adapted for use with the small elastic strands of such an elastic mesh.

DESCRIPTION OF THE ILLUSTRATED EMBODIMENTS

Figure 5:
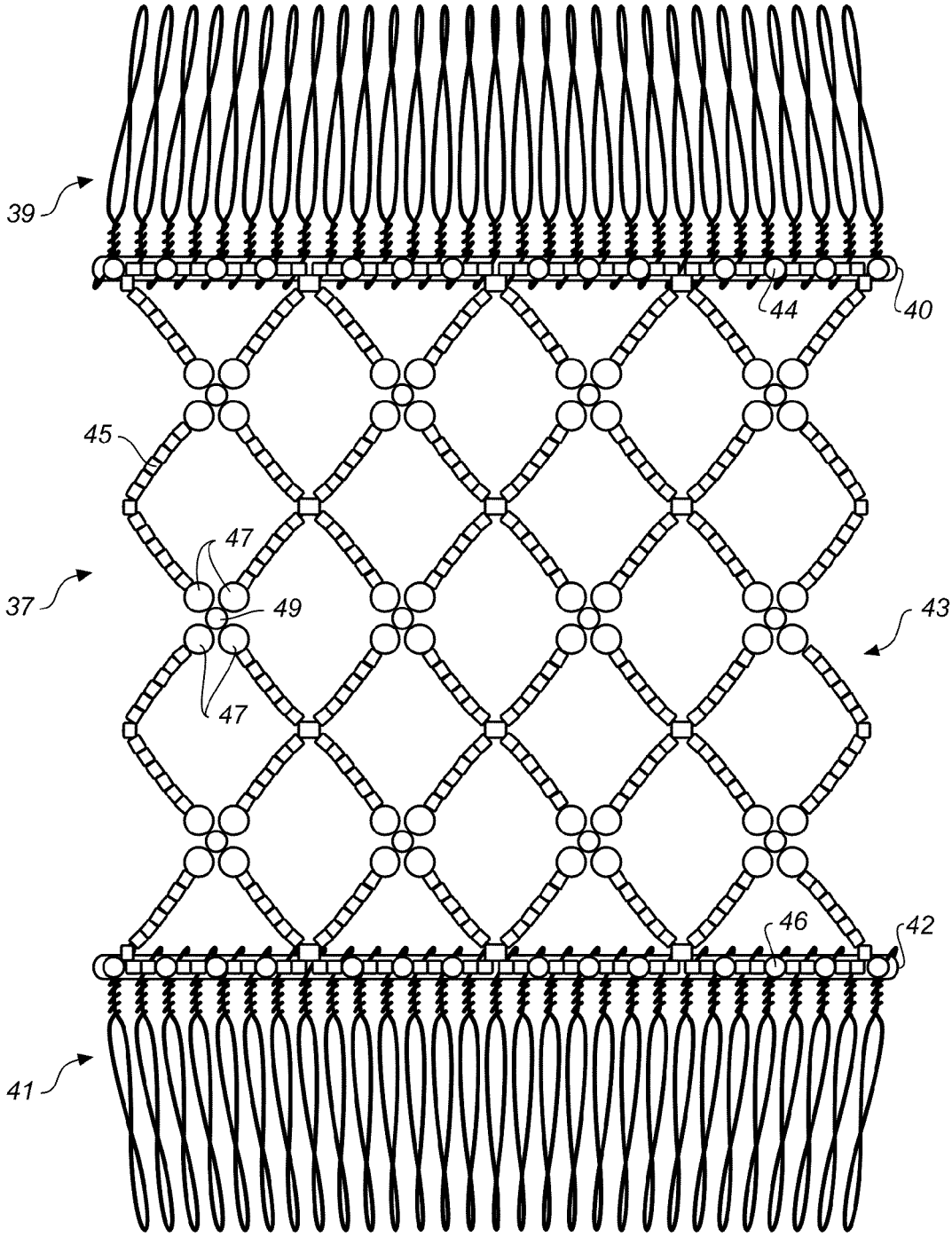
FIG. 5 is a top plan view of another version of the stretch comb hair retainer of the invention showing a different decorative bead arrangement on the elastic mesh.

Referring now to the drawings, FIGS. 1-4 show a stretch comb hair retainer in accordance with the invention with a first beaded design, and FIG. 5 shows a stretch comb hair retainer in accordance with the invention with a second beaded design. The beaded designs shown in the drawings are illustrative only. Stretch comb assemblies in accordance with the invention can be made without beads, or with ornamentation other than beads, such as, for example, buttons. Also, hair strands can be tied onto the mesh of the retainer as described below to provide hair enhancement.

Turning to the embodiment shown in FIGS. 1-4, the stretch comb hair retainer 10 includes opposed wire combs 11, 13 having metal spines 15, 17 and wire loop teeth 19, 21. The wire loop teeth are attached to the spines of the combs by twisting them onto the spines. Twisted bases, such as bases 23 of comb 13, are thereby formed at the bottom of the comb teeth, and it is about these twisted bases that the comb teeth can enjoy a degree of flexture. The flexible wire loops allow hair to be pulled smoothly through the teeth of the combs while providing a sufficient gripping force to keep the combs in place. Also, the smooth round tip of the wire loops of the comb teeth prevent the combs from biting into the scalp when the combs are inserted into and through the hair as the retainer is put into place on the wearer's head.

Figure 3:
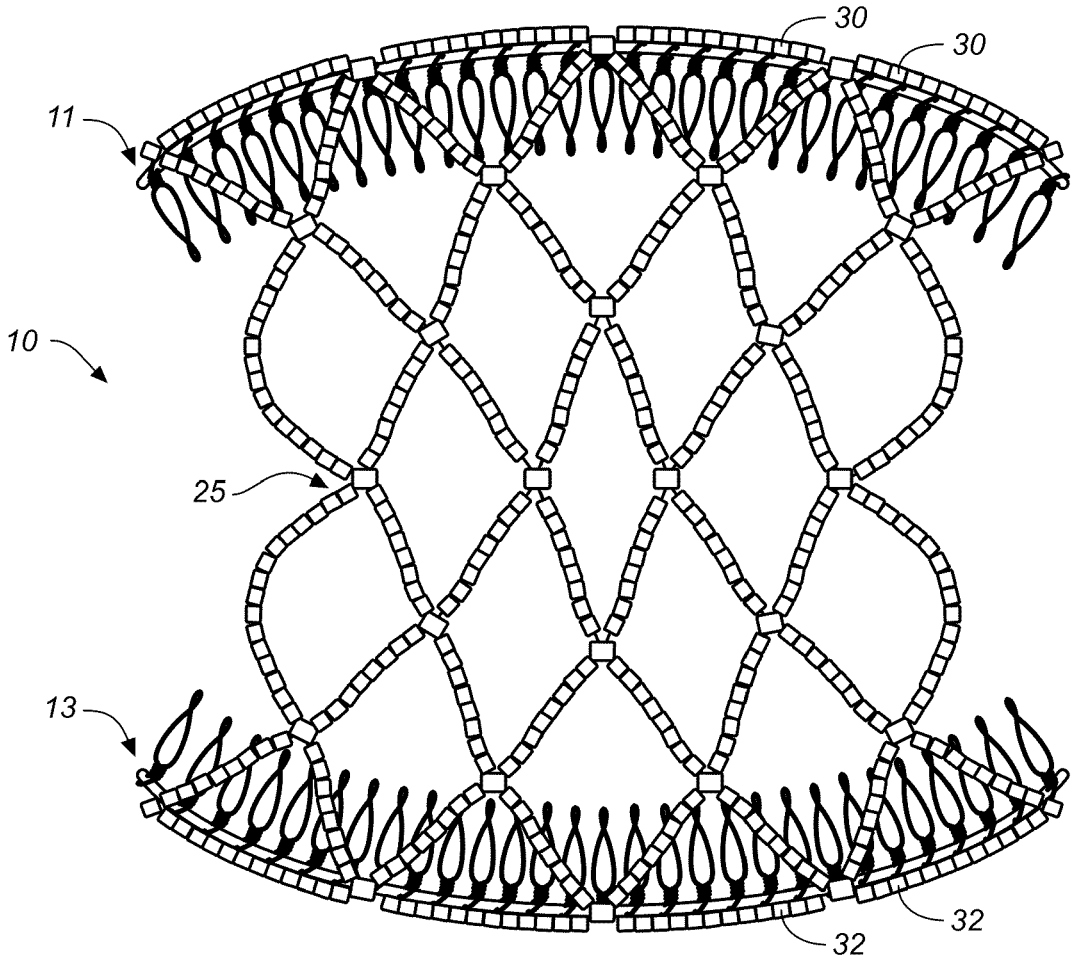
FIG. 3 is another top plan view of the stretch comb hair retainer shown in FIG. 1 with the combs turned down ninety degrees to show the curvature of the combs.
Figure 4:
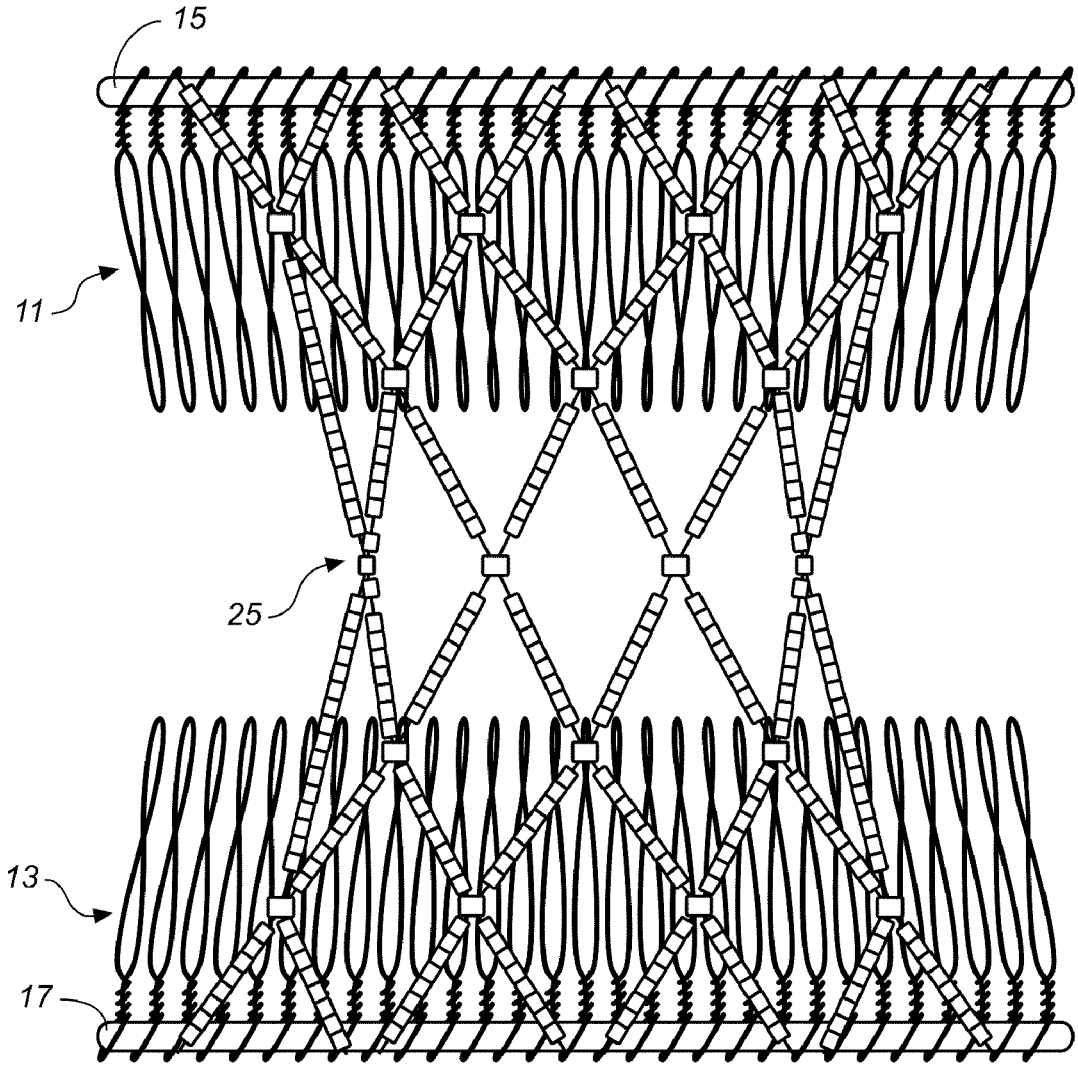
FIG. 4 is a further top plan view thereof illustrating the combs in the inverted position they would be in during normal use.

As shown in FIG. 3, the spine and teeth of the comb have a curvature intended to substantially replicate the curve of the scalp. This shaping of the comb is well-known and is important to comfort and the long-wearing capabilities of the stretch comb hair retainer of the invention. The small diameter wires and thin spine of the combs also produce low profile combs as best seen in FIG. 3. Thus, a less obtrusive stretch comb retainer can be provided as compared to stretch comb retainers using the more bulky plastic combs. Because of their low profile, the combs will in most instances be well hidden under the hair.

The combs 11, 13 are connected by elastic strands, denoted a-h, attached to the spines 15, 17 of the combs. Elastic strands a-h are interconnected to form a elastic mesh 25 of small stretchable openings 27 through which the wearer can pull a desired amount of hair. The stretchable openings of the mesh have a general diamond or partial diamond shape, with smaller half diamond openings 29 being presented along the spine of the comb where the mesh attaches to the spine. Hair can be pulled through any of the multiple stretchable openings of the mesh as desired to create particular hair styles, and each opening can be stretched independently of other openings, which facilitates styling. It shall be understood that a stretch comb hair retainer in accordance with the invention may as well be used without pulling hair through the mesh, in which case the mesh is simply lies over and captures the hair between the combs.

Suitably the length of the unstretched elastic mesh between combs will be in the range of about 3½ to 4 inches. The mesh should be symmetrical and balanced about the centerline C of the stretch comb retainer. Otherwise, it is found that the retainer will have a tendency to slide out of position and even fall out of the hair.

Figure 2:
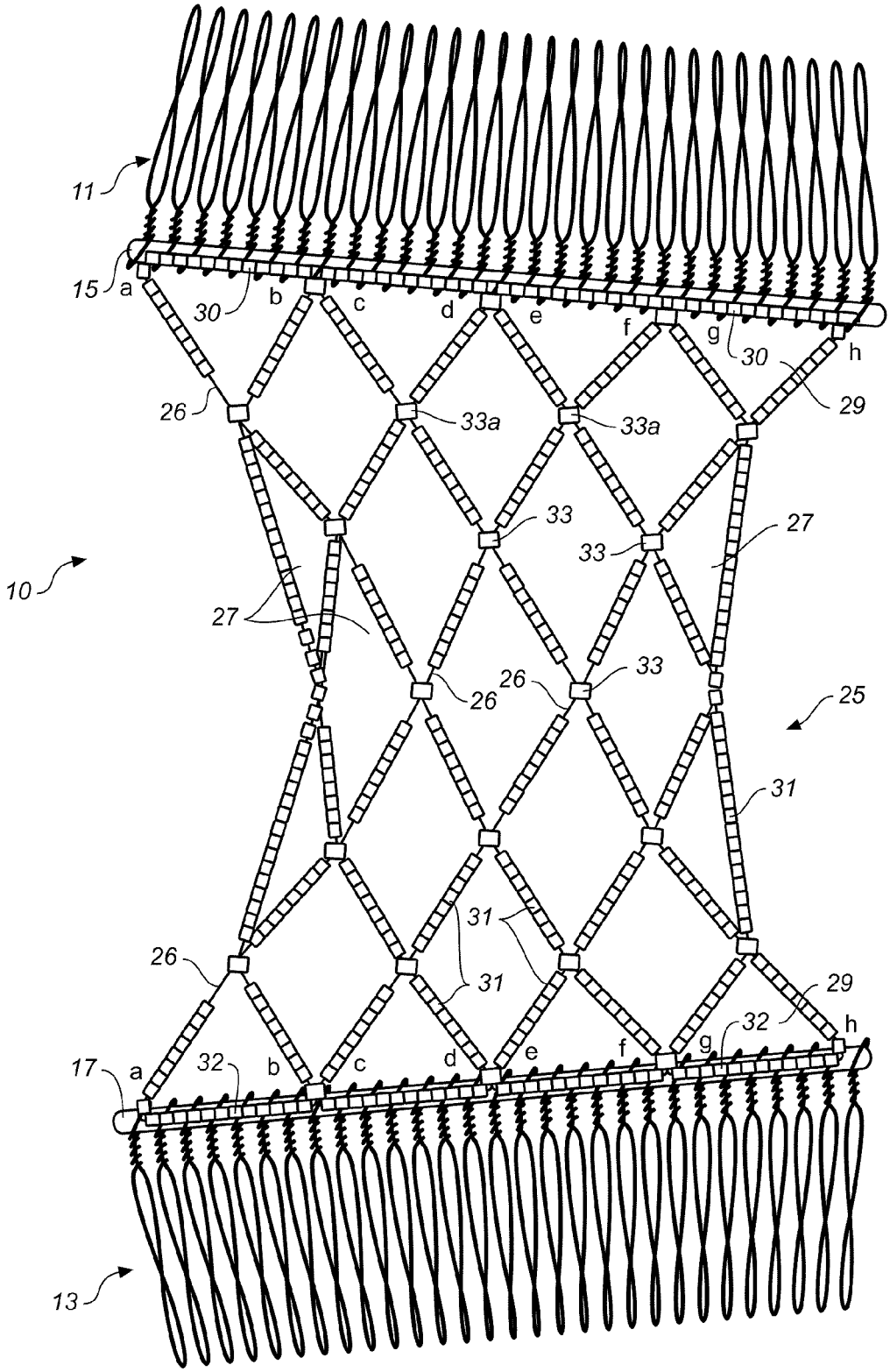
FIG. 2 is a top plan view of the stretch comb hair retainer shown in FIG. 1 wherein the combs have been stretched apart to stretch the elastic mesh.

The strands of the elastic mesh should be a strong elastic material, preferably a very fine elastic filament material, such as the beaded elastic filament 26 seen in FIG. 2, which is suitably made of a resin based elastic. A clear resin based elastic filament would produce a mesh that is substantially invisible to the eye, if such a feature is desired. Alternatively, fabric covered elastic bands could be used, however, such an elastic material would not be suitable for beading the strands as hereinafter described. Whatever elastic is used, it should have a strong enough memory and elongation set, so that it returns to its original shape upon being repeatedly stretched. However, it is noted that the woven mesh of the invention has the advantage of inherent strength by distributing the stretching force over the multiple strands of the mesh.

As above noted, the strands a-h of the elastic mesh 25 can be beaded to provide a decorative mesh. In the embodiment shown in FIGS. 1-4, connector beads 33 are used for this purpose along with intermediate beads 31 between the connector beads and between the first row of connector beads 33*a* and the spins of the combs. The connector beads are used to interconnect the strands of the mesh, and the intermediate beads, shown in FIGS. 1-4 as small, uniformly sized "seed" beads, provide a fill beads between the connector beads. More specifically, adjacent strands of the mesh are threaded through connector beads 33 in order to tie the strands together at spaced intervals to form a weave. The intermediate spacing of the weave intersections, which determine the size of the elastic openings 27, 29 of the mesh, are set by the number of beads 31 threaded onto the filaments between connector beads. In other words, the size of the mesh openings is established by counting out the number of beads between connector beads, or in the case of mesh openings 29, the number of beads between the spines 15, 17 of combs 11, 13 and the first row of connector beads 33*a*.

Referring to FIG. 5, a different beading design is shown for the elastic mesh of the comb. Here a stretch comb hair retainer 37, comprised of wire combs 39, 41 and elastic mesh 43, has a woven mesh bead design which includes both small intermediate seed beads 45 and larger faceted beads 47, 49, which form a flower-like cluster of beads at the intersections of the weave of the mesh. The center bead 49 of the bead cluster provides the connector bead for weaving the meshes' elastic strands together. The large faceted beads 47 and seed bead count will set the spacing of the weave intersections.

Figure 6:
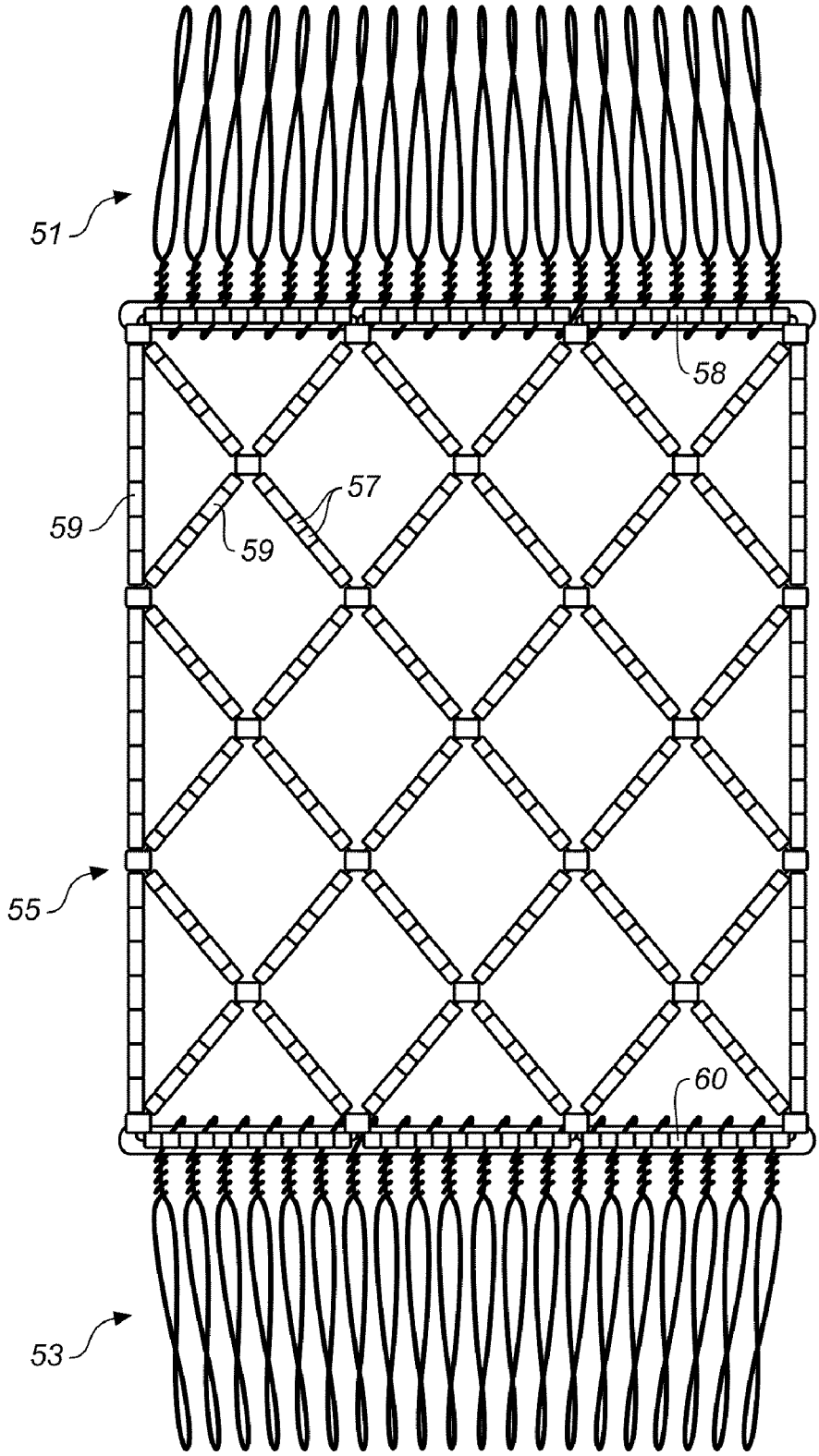
FIG. 6 is a top plan view of a further version of the stretch comb hair retainer of the invention showing yet another decorative bead arrangement on the elastic mesh.

FIG. 6 shows yet another beading design for the elastic mesh. Here wire combs 51, 53 are connected by an elastic mesh 55 having a combination of small seed beads 57 and elongated bugle beads 59. As with the designs shown in FIGS. 1-5, beads can be provided in different colors for decorative effect. Also, in FIG. 6 it is noted that the width of the combs and elastic mesh of the stretch comb retainer is somewhat smaller than the combs and mesh of the FIGS. 1-5 retainers. Preferably, four inch combs are used for optimum staying power, however, three inch combs have been found to work. The invention contemplates the possibility of using larger or smaller combs.

Decorative or functional elements other than, or in addition to, beads could be fastened to the elastic mesh of the invention for achieving a desired hair styling objective. For example, hair strands could be affixed to all or part of the mesh to provide the wearer of the stretch comb retainer with an added tuft of hair that can be blended in with natural hair pulled through the stretchable openings of the elastic mesh. Also, the intersections of the weave could be tied together by means other than the illustrated connector beads. A weave, for instance, might be created using buttons or ties to hold the strands of the mesh together.

Figure 1:
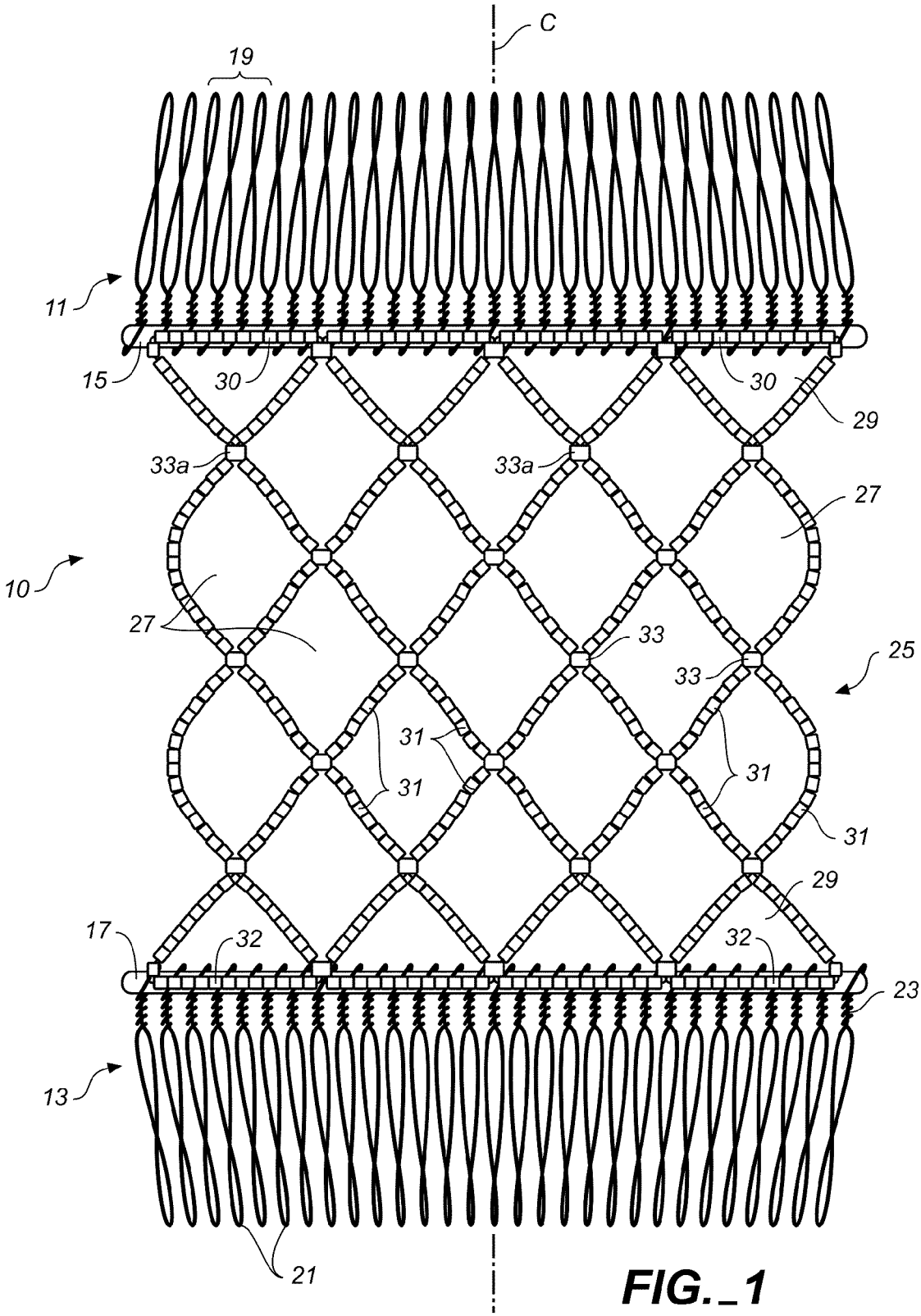
FIG. 1 is a top plan view of a stretch comb hair retainer in accordance with the invention showing a beaded elastic mesh.

The elastic mesh of the invention can be created by one or multiple elastic strands threaded between the spines of the combs. Referring to FIGS. 1 and 2, a continuous length of fine resin-based elastic filament strands can be used to create the interwoven elastic strands a-h of the mesh 25. Starting with strand segment "a," the first end of the first continuous filament strand is secured to the end of spine 15 of comb 11, such as by tying the end at this point. A selected count of intermediate beads are threaded onto this first strand to create filament strand segment "a." The free end of the filament strand is then wrapped around or otherwise secured to the spine 17 of opposing comb 13 to fix the second end of strand segment "a" in opposition to its first end. From here the length of elastic strand is stretched down the spine 17 a distance to where strand segment "b" takes off from the spine. The strand's free end is then wrapped around or otherwise secured to the spine at this spot to fix its position and then threaded back toward comb 11 through the connector beads 33 on strand segment "a." While doing this, strand segment "b" is beaded with the selected bead count between the spines of the combs and the first row of connector beads 33*a* and between intermediate connector beads. This weaving and beading process is continued until the free end is tied off on the spine of one of the combs after completing the last strand segment. If one continuous filament strand is used, the end would be tied off at the end of strand segment "h." By using two elastic strands, the weaver of the mesh can start at opposite ends of the comb spines and tie off in the middle of the spines. A line of beads can be added to the lengths of elastic strands that extend along the comb spines for decorative effect and to hide the strands which course along the spines. Such a line of beads is denoted by the numerals 30, 32 and 58, 60 in the embodiments shown FIGS. 1-3 and 6 of the drawings. In FIG. 5, a similar line of beads having a somewhat different appearance is shown to cover spines 40, 42 of combs 39, 41.

It is seen that the weave of the elastic mesh of the invention allows for different sized mesh openings. These different sized openings can be advantageously used to pull different amounts of wearer's hair through the stretch comb retainer. Again, this enhances the flexibility of the retainer both in creating different hair styles and in allowing the retainer to be used with different types of hair, such as thin or fine hair which is difficult to style. The smaller half-sized openings of the mesh along the spine of each comb provide the added benefit of comfortably accommodating the wearer's finger tips, thereby allowing the wearer to get a good grip on the combs without getting caught up in the elastic mesh.

It is noted that the elastic mesh 25 of each of the illustrated embodiments of the invention has eight comb-to-comb elastic strands. This number of strands, preferably used with a comb having a width of about four inches, has been found to provide an optimum stretch comb hair retainer in terms of strand spacing, balance, strength and overall aesthetic design. However, it shall be understood that a stretch comb hair retainer in accordance with the invention could be provided with an elastic mesh having more or fewer strand segments. It shall also be appreciated that the elastic mesh could be woven in a manner other than described herein. Preferably, the weave pattern will be balanced about the centerline of the retainer to give the retainer the balance it needs to stay on the hair.

Therefore, the present invention is a new and novel stretch comb hair retainer that provides great flexibility in creating different hairstyles and ornamentations for hair, and that is usable by wearers having different hair types. The present invention overcomes many of the disadvantages and limitations of known stretch comb hair retainers and provides wearers with capabilities heretofore unknown for such hair retainers.

What I claim is:

1. A stretch comb hair retainer comprising two opposed wire combs, each of said combs having a spine defining the width of the comb and a row of looped wires attached to and projecting from said spine to form the teeth of the comb, and a stretchable elastic mesh secured between the spines of said combs to produce tension between said combs when said combs are moved away from each other, said elastic mesh having a width comparable to the width of said combs and being formed by elastic strands extending between the spines of the combs so as to form stretchable openings which can individually be stretched open so that an amount of the wearer's hair can be pulled therethrough, and wherein the elastic strands are strung between the spines of the combs have a plurality of beads threaded thereon to provide a decorative elastic mesh.

2. The stretch comb hair retainer of claim 1 wherein said elastic strands are secured at spaced intervals to the spines of said opposed combs.

3. The stretch comb hair retainer of claim 1 wherein said elastic strands are interconnected and form an elastic mesh formed at least in part by generally triangular shaped stretchable openings.

4. The stretch comb hair retainer of claim 3 wherein the stretchable openings of said elastic mesh are of at least two different sizes.

5. The stretch comb hair retainer of claim 1 wherein said elastic mesh is formed by interconnected elastic strands.

6. The stretch comb hair retainer of claim 1 wherein said strands are substantially clear elastic strands.

7. The stretch comb hair retainer of claim 1 wherein the plurality of beads threaded on said elastic strands include connector beads interconnecting said elastic strands to form a woven elastic mesh.

8. The stretch comb hair retainer of claim 7 wherein the plurality of beads threaded on said elastic strands include intermediate beads on said elastic strands between said connector beads.

9. The stretch comb hair retainer of claim 8 wherein the number of intermediate beads between each of the connector beads of said elastic mesh is substantially the same.

10. The stretch comb hair retainer of claim 1 wherein the length of the elastic mesh between said combs, when unstretched, is between about three and one-half to four inches.

11. The stretch comb hair retainer of claim 1 wherein the width of said combs is between about three to four inches.

12. The stretch comb hair retainer of claim 1 wherein the width of said combs and said elastic mesh is between about three to four inches.

13. A stretch comb hair retainer comprising two opposed wire combs, each of said combs having a spine defining the width of the comb and a row of looped wires forming comb teeth attached to and projecting from the spine, elastic strands secured at spaced intervals along the spines of the combs, and a plurality of beads on said elastic strands including connector beads, said elastic strands being threaded through said connector beads to form a woven elastic mesh of interconnected strands between the spines of said opposed combs which produces tension between said combs when said combs are moved away from each other, said elastic mesh having stretchable openings which can individually be stretched open so that the wearer can pull an amount of hair therethrough if desired, and having a width comparable to the width of said combs.

14. The stretch comb hair retainer of claim 13 wherein said elastic strands are formed by at least one continuous length of elastic strand wrapped around the spines of said combs to produce strand segments that are threaded through said connector beads.

15. The stretch comb hair retainer of claim 13 wherein intermediate beads are threaded onto said elastic strands between said connector beads to produce a desired decorative effect.

16. The stretch comb hair retainer of claim 15 wherein the shapes, colors, and sizes of said connector and intermediate beads are selected and mixed to produce a desired decorative effect.

17. The stretch comb hair retainer of claim 15 wherein the intermediate beads surrounding said connector beads are larger than other intermediate beads to accentuate the interconnections of the woven elastic mesh.

18. A stretch comb hair retainer comprising two opposed wire combs, each of said combs having a spine and wire loop comb teeth projecting from the spine, and each of said combs having a width of about three to four inches; and an elastic mesh connected between the spines of said opposed combs, said elastic mesh having stretchable openings formed by elastic strands woven between the spines of said combs which can individually be stretched open so that the wearer can pull an amount of hair through one or more of said openings if desired, said elastic mesh further having an unstretched length as measured between the spines of said combs of between about three and one-half to four inches, and having a width which is about the same as said combs, said elastic strands having a plurality of beads thereon.

19. The stretch comb hair retainer of claim 18 wherein eight elastic stands are secured at spaced intervals along the spines of said opposed combs and are interconnected to form an elastic mesh of interconnected elastic strands between said combs.

20. A stretch comb hair retainer comprising two opposed wire combs, each of said combs having a spine and looped wires forming parallel comb teeth attached to and projecting from the spine, an elastic mesh comprised of cris-crossed elastic strands having a plurality of beads threaded thereon, said cris-crossed elastic strands providing stretchable openings and being attached to and extending between the spines of said opposed combs, said elastic mesh being formed by threading and simultaneously threadedly beading at least one elastic strand back and forth between the spines of said combs.

21. The stretch comb hair retainer of claim 20 wherein said elastic strand is beaded with connector beads, wherein the elastic strand is threaded through said connector beads, and wherein said connector beads interconnect the filament strand in an elastic mesh with stretchable openings.

22. The stretch comb hair retainer of claim 21 wherein said elastic strand is threaded back and forth between the spines of said first and second combs to produce eight strand segments woven through said connector beads.

23. A stretch comb hair retainer comprising two opposed wire combs, each of said combs having a metal spine and a row of looped wires attached to and projecting from said metal spine to form parallel projecting teeth of the comb; and a plurality of elastic strands extending between and secured at spaced intervals along the spines of said wire combs forming, at least some of said elastic strands being cris-crossed to form a mesh of crossed strands having stretchable openings between the spines of said opposed wire combs which can individually be stretched open so that the wearer can pull a desired amount of the wearer's hair therethrough, said cris-crossed elastic strands having a plurality of beads thereon.

24. The stretch comb hair retainer of claim 23 wherein the width of said combs is between about three to four inches.

25. The stretch comb hair retainer of claim 24 wherein the distance between the spines of said combs, when the elastic strands are unstretched, is between about three and one-half to four inches.

26. A stretch comb hair retainer comprising two opposed wire combs, each of said combs having a metal spine defining the width of the comb and a row of looped wires attached to and projecting from said metal spine to form parallel projecting teeth of the comb; and a plurality of elastic strands extending between and secured at spaced intervals along the spines of said wire combs, said elastic strands being strung in cris-cross fashion between the metal spines of said opposed combs so as to form a mesh of crossed strands having stretchable openings between said elastic strands through which an amount of the wearer's hair can be pulled, said cris-crossed elastic strands having a plurality of beads threaded thereon.

27. The stretch comb hair retainer of claim 26 wherein said elastic strands are threadedly beaded as they are strung back and forth between the spines of said wire combs.

28. A stretch comb hair retainer comprising two opposed wire combs, each of said combs having a spine defining the width of the comb and a row of looped metal wires attached to and projecting from said spine to form parallel projecting teeth of the comb, said looped metal wires being attached to said spine by twisting to form twisted bases at the spine; and a plurality of elastic strands strung between the spines of said wire combs so that they secure to the spine of said combs at spaced intervals over the width of the comb, said strands having a plurality of beads thereon and being threadedly beaded as they are strung between the spines of said wire combs, of said elastic strands being crossed over other strands to form a mesh of crossed strands having stretchable openings.

* * * * *

UNITED STATES PATENT AND TRADEMARK OFFICE

CERTIFICATE OF CORRECTION

PATENT NO. : 7,748,390 B2
APPLICATION NO. : 10/764279
DATED : July 6, 2010
INVENTOR(S) : Francesca B. Kuglen It is certified that error appears in the above-identified patent and that said Letters Patent is hereby corrected as shown below:

Title page, item [57], In the abstract, line 4, "a elastic" should read --an elastic--.
Title page, item [57], In the abstract, line 5, "hold" should read --holds--.
In column 1, line 39, --they-- should be inserted between "and" and "limit.".
In column 4, line 13, "spins" should read --spines--.
In column 4, line 16, "a" should be deleted between "provide" and "fill.".
In column 6, line 10, --and-- should be inserted between "combs" and "have.".
In column 8, line 8, "combs forming, at" should read --combs, at--.

Signed and Sealed this

Ninth Day of November, 2010

David J. Kappos

David J. Kappos
*Director of the United States Patent and Trademark Office*